US008596033B2

(12) United States Patent
Le Percq et al.

(10) Patent No.: US 8,596,033 B2
(45) **Date of Patent: *Dec. 3, 2013**

(54) MULTILAYER METAL FIBER YARN

(75) Inventors: Lisa Le Percq, Ghent (BE); Stefaan De Bondt, Heestert (BE); Henk Troost, Gullegem (BE)

(73) Assignee: NV Bekaert SA, Zwevegem (BE)

( * ) Notice: Subject to any disclaimer, the term of this patent is extended or adjusted under 35 U.S.C. 154(b) by 0 days.

This patent is subject to a terminal disclaimer.

(21) Appl. No.: 13/130,919

(22) PCT Filed: Nov. 24, 2009

(86) PCT No.: PCT/EP2009/065771

§ 371 (c)(1),
(2), (4) Date: May 24, 2011

(87) PCT Pub. No.: WO2010/060910

PCT Pub. Date: Jun. 3, 2010

(65) Prior Publication Data

US 2011/0225945 A1 Sep. 22, 2011

(30) Foreign Application Priority Data

Nov. 25, 2008 (EP) ..... 08169882

(51) Int. Cl.
*D02G 3/02* (2006.01)

(52) U.S. Cl.
USPC ..... 57/237

(58) Field of Classification Search
USPC ..... 57/237, 243; 219/552, 553
See application file for complete search history.

(56) References Cited

U.S. PATENT DOCUMENTS

| | | | | |
|---|---|---|---|---|
| 2,050,298 | A | 8/1936 | Everett | |
| 3,277,564 | A | 10/1966 | Webber et al. | |
| 3,379,000 | A | 4/1968 | Webber et al. | |
| 3,394,213 | A | 7/1968 | Roberts et al. | |
| 3,451,305 | A | 6/1969 | Christensen et al. | |
| 3,601,970 | A | 8/1971 | Roberts et al. | |
| 4,067,375 | A * | 1/1978 | Lejeune | 152/540 |
| 6,144,018 | A * | 11/2000 | Heizer | 219/529 |
| 6,530,205 | B1 * | 3/2003 | Gentry et al. | 57/237 |
| 6,863,103 | B1 * | 3/2005 | Masubuchi et al. | 152/451 |

(Continued)

FOREIGN PATENT DOCUMENTS

| | | | |
|---|---|---|---|
| CN | 101307518 | A | 11/2008 |
| EP | 1 362 941 | A1 | 11/2003 |

(Continued)

OTHER PUBLICATIONS

Klaus Feyrer, Drahtseile: Bemessung, Betrieb, Sicherheit, 2000, pp. 22-23, Springer-Verlag, Berlin.

(Continued)

*Primary Examiner* — Shaun R Hurley
(74) *Attorney, Agent, or Firm* — Foley & Lardner LLP

(57) ABSTRACT

A new metal fiber yarn (1) and methods for obtaining such a yarn are provided. The metal fiber yarn comprises at least 9 bundles (8) of continuous metal fibers. Each of the bundles comprises at least 30 metal fibers (7). The at least 9 bundles are arranged in at least 2 layers of continuous metal fiber bundles as seen over a transverse cross section through the metal fiber yarn. This new metal fiber yarn has an increased flexlife and strength.

14 Claims, 2 Drawing Sheets

(56) References Cited

U.S. PATENT DOCUMENTS

| | | | | |
|---|---|---|---|---|
| 7,291,391 | B2 * | 11/2007 | Watson et al. | 428/389 |
| 2003/0006226 | A1 | 1/2003 | Yanagimoto et al. | |
| 2007/0278214 | A1 | 12/2007 | Weiss et al. | |
| 2008/0203064 | A1 * | 8/2008 | Holvoet et al. | 219/50 |
| 2011/0079589 | A1 * | 4/2011 | De Greve et al. | 219/202 |
| 2011/0114619 | A1 * | 5/2011 | Amils et al. | 219/202 |
| 2011/0225946 | A1 * | 9/2011 | Le Percq et al. | 57/243 |
| 2011/0240626 | A1 * | 10/2011 | Mullebrouck et al. | 219/260 |

FOREIGN PATENT DOCUMENTS

| | | | |
|---|---|---|---|
| EP | 1 722 017 | A1 | 11/2006 |
| JP | 51-6846 | A | 1/1976 |
| JP | 5-177243 | A | 7/1993 |
| JP | 10-18189 | A | 1/1998 |
| WO | WO 97/04152 | A1 | 2/1997 |
| WO | WO 03/095724 | A1 | 11/2003 |
| WO | WO 2005-089019 | A2 | 9/2005 |
| WO | WO 2006-120045 | A1 | 11/2006 |
| WO | WO 2007/065606 | A1 | 6/2007 |
| WO | WO 2007-099019 | A1 | 9/2007 |

OTHER PUBLICATIONS

U.S. Appl. No. 13/130,958, filed May 23, 2011, Rik Mullebrouck et al.

U.S. Appl. No. 13/130,935, filed May 24, 2011, Lisa Le Percq et al.

USPTO Office Action, U.S. Appl. No. 13/130,958, Dec. 19, 2012, 11 pages.

USPTO, Office Action, U.S. Appl. No. 13/130,935, Nov. 5, 2012, 10 pages.

USPTO Notice of Allowance, U.S. Appl. No. 13/130,935, Mar. 5, 2013, 9 pages.

USPTO Office Action, U.S. Appl. No. 13/130,958, Jul. 9, 2013, 9 pages.

* cited by examiner

MULTILAYER METAL FIBER YARN

TECHNICAL FIELD

The present invention relates to continuous metal fibers and bundles of continuous metal fibers, e.g. obtained by the bundled drawing of wires. More specifically, the present invention relates to high quality metal fiber yarns and the method of producing these metal fiber yarns.

BACKGROUND ART

Metal fiber bundles can be obtained in various ways. Metal fibers can be obtained by a method of bundled drawing as described e.g. U.S. Pat. No. 3,379,000. Metal fibers can also be obtained e.g. by drawing till final diameter, also called end drawing. Typically, metal fibers are less than 60 μm in equivalent diameter. A metal fiber bundle is generally characterised as an array of parallel metal fibers. One type of metal fiber bundles include continuous metal fibers e.g. as obtained by bundled drawing or end drawing and combining these metal fibers into a bundle. Such metal fiber bundles can then be combined to produce metal fiber yarns. These yarns have properties such as a determined strength and electrical resistance.

To increase the strength of a metal fiber yarn with continuous metal fibers of a certain thickness, more metal fibers need to be in the yarn. This can be done in two ways: by increasing the amount of metal fibers in the bundles or by increasing the amount of metal fiber bundles in the yarn.

Increasing the amount of metal fibers per bundle in the yarn has, however, a negative effect on the flexibility of the metal fiber yarn.

The smaller than expected increase in breaking load of the yarns consisting out of 5 or more metal fiber bundles occurring together with an increase in the sleeving phenomenon, made people in the art conclude that using 5 or more metal fiber bundles in a yarn was not favourable.

Accordingly, this invention seeks to provide metal fiber yarns with higher flexibility and flexlife. In a further elaboration of this invention, metal fiber yarns are provided with increased strength and processability.

DISCLOSURE OF INVENTION

An aspect of the claimed invention provides a metal fiber yarn which comprises at least 9 bundles of continuous metal fibers. Each of the bundles comprises at least 30 metal fibers. The at least 9 bundles are arranged in at least 2 layers of continuous metal fiber bundles as seen over a transverse cross section through the metal fiber yarn. More preferably, the at least 9 bundles are arranged in at least 3 layers as seen over a transverse cross section through the metal fiber yarn.

The metal fiber bundles are combined into a metal fiber yarn, e.g. by twisting them together with a predetermined number of torsions per meter. Bundles having similar distance from their centre to the yarn's centre are considered as part of the same layer of bundles in the yarn. In a preferred embodiment, the number of torsions per meter is adapted per layer.

Even more preferably, the number of torsions per layer is adapted such that the bundles in the different layers all have the same length. This even more preferred embodiment of the invention provides a metal fiber yarn wherein the length of the fiber bundles is substantially equal per unit length of said metal fiber yarn. At the same time these fiber bundles have a length per unit length of said metal fiber yarn which is larger than the unit length of the metal fiber yarn. These types of metal fiber yarns provide the further advantage that also a high strength metal fiber yarn with good processability is obtained.

In another preferred embodiment, the number of torsions per meter is the same for all metal fiber bundles in the metal fiber yarn. More preferably, all the bundles in the different layers of the metal fiber yarn are twisted in the same direction, this is what is called in the art an SS or ZZ construction. This provides a metal fiber yarn which, next to a better flexlife also has a high strength. Even more preferably, the metal fiber yarn is produced layer per layer thereby obtaining a metal fiber yarn with an increased elongation.

In an alternative more preferred embodiment, the bundles in subsequent layers of metal fiber yarn are twisted in opposite direction. This is what is called in the art S and Z twist. By using a different twist in the subsequent layers, the yarn structure will not develop a torque when longitudinally loaded.

In another preferred embodiment, at least part of the metal fibers are bundle drawn metal fibers. In still another preferred embodiment, at least part of the metal fibers are made of stainless steel.

The bundle or bundles of the yarns according to the present invention are preferably obtained by a bundle-drawing process. Such a process is generally known and involves the coating of a plurality of metal wires (a bundle), enclosing the bundle with a cover material to obtain what is called in the art a composite wire, drawing the composite wire to the appropriate diameter and removing the cover and coating material of the individual wires (fibres) and the bundle, as e.g. described in U.S. Pat. No. 3,379,000; U.S. Pat. No. 3,394,213; U.S. Pat. No. 2,050,298 or U.S. Pat. No. 3,277,564. The fibers obtained with this process have a cross section which is polygonal, usually pentagonal or hexagonal in shape, and their circumference is usually serrated, as is shown in FIG. 2 of U.S. Pat. No. 2,050,298. Compared to grouping a plurality of single-drawn fibres together to form a bundle, the bundle-drawn process allows the fibre diameter to be reduced further. It has been observed that a reduced fibre diameter also has a positive effect on the flexlife.

The metal fibres as applied in the bundles of the yarns according to the invention can be single drawn or bundle drawn. A description of bundle drawing is provided above. For a single drawn fibre the diameter reduction is done by means of a series of dies for one fibre. For bundle drawn fibres the diameter reduction is done by means of a single series of dies for the whole bundle. In case of the bundle drawing operation, the cross section of a fiber has usually a pentagonal or hexagonal shape as shown in FIG. 2 of U.S. Pat. No. 2,050,298, and the circumference of the fiber cross section is usually serrated as opposed to a single drawn fiber, which has a circular cross section.

In the present invention, metal is to be understood as encompassing both metals and metal alloys (such as stainless steel or carbon steel). Preferably, the metal fibers are made of stainless steel, such as e.g. AISI 316, 316L, 302, 304. In another preferred embodiment the metal fibers are made of FeCrAl-alloys, copper or nickel. In another preferred embodiment, the metal fibers are multilayer metal fibers such as described in JP 5-177243, WO 03/095724 and WO 2006/120045, e.g. metal fibers with a core of copper and an outer layer of stainless steel or metal fibers in three layers with a core of steel, an intermediate layer of copper and an outer layer of stainless steel. The metal fibers can be produced either by direct drawing or by a bundled drawing technique. The metal fibers in the yarn have a preferred equivalent diameter in the range of 0.5 to 60 μm, more preferably in the range of 2 to 60 μm, even more preferably in the range of 6 to 40 μm, most preferably in the range of 8 to 30 μm.

Each bundle of continuous metal fibers comprises at least 30 metal fibers and preferably less than 2500 metal fibers over a transverse cross section. In a more preferred embodiment each bundle of continuous metal fibers comprises 1000 fibers. In an alternative preferred embodiment each bundle of continuous metal fibers comprises 275 or 90 fibers. In another alternative embodiment, the yarn comprises bundles with different amounts of metal fibers, e.g. bundles with 275 fibers combined with bundles with 90 fibers. The amount of continuous fiber bundles in the yarn is preferably equal to or less than 30, such as 9, 10, 11, 12, 13, 14, 15, 16, 17, 18, 19, 20, 21, 22, 23, 24, 25, 26, 27, 28, 29.

The metal fiber yarn can further be coated with a suitable coating, preferably PVC, PVA, PTFE (polytetrafluoroethylene) FEP (copolymers of tetrafluoromethylene and hexafluoropropylene), MFA (perfluoroalkoxy polymer) or polyurethane lacquer. Alternatively, the metal fiber yarn can also comprise a lubricant.

Another aspect of the claimed invention provides a metal fiber yarn according to the invention wherein at least part of the metal fiber bundles are plastically preformed, e.g. crimped.

Another aspect of the invention provides use of the metal fiber yarn of the invention as resistance heating elements in heatable textile applications, e.g. car seat heating.

Another aspect of the invention provides the use of the metal fiber yarn of the invention as sewing yarn.

Another aspect of the invention provides the use of the metal fiber yarn of the invention as lead wire.

Another aspect of the invention provides the use of the metal fiber yarn of the invention for the production of heat resistant textiles, such as separation material as used in the production of car glass, e.g. for the molding of car glass to the desired shape, or such as burner membranes in woven or knitted form.

Another aspect of the invention provides the use of the metal fiber yarn of the invention as reinforcement elements in composite materials.

Another aspect of the claimed invention provides methods for producing the metal fiber yarns of the present invention.

A first method obtains the metal fiber yarn according to the invention by providing at least 9 metal fiber bundles, preferably each of the bundles is a bundle of bundle drawn metal fibers. Each of the bundles comprises at least 30 metal fibers, preferably less than 2500. The metal fiber bundles are twisted together. In this method the yarn is made in two or more steps: in the first step at least 2 bundles of continuous metal fibers are twisted around each other with a predetermined number of torsions per meter. In a second step the remaining bundles are twisted around the first layer with a predetermined number of torsions per meter. More layers can be added in more steps. The number of torsions per meter may be different or the same for the different layers in the yarn. In a preferred method, the bundles in different layers are twisted in the same direction in order to obtain a yarn with a high strength and a high elongation. In another preferred method, the bundles in the different layers are twisted in opposite directions in order to obtain a yarn which will not develop a torque when longitudinally loaded. In still another preferred method, to obtain an equal length of all fiber bundles in all layers, the cabling angles of the different layers need to be the same.

A second, alternative preferred method is similar to the first method provided all bundles are metal fiber bundles obtained through bundled drawing and wherein each bundle is still in the form of a composite wire drawn to final diameter, with each of the composite wires comprising a number of filaments in a matrix.

This method further comprises the step of removing the matrix and sheet from the composite wires by dissolving the sheet and matrix in appropriate acid, after making the construction. In a further preferred method, the cabling angles of the different layers of the composite wires are set such that after leaching the cabling angles of the different layers become the same thereby obtaining a metal fiber yarn with substantially equal lengths of all fiber bundles in all layers, per unit length of the construction.

A third method obtains the metal fiber yarn according to the invention by providing at least 9 metal fiber bundles, preferably each of the bundles is a bundle of bundle drawn metal fibers. Each of the bundles comprises at least 30 metal fibers, preferably less than 2500. In this method the yarn is made in one step: all metal fiber bundles in the different layers are twisted around each other in one step with the same predetermined number of torsions per meter. This results in a yarn with a high strength and a low elongation.

A fourth method is similar to the third method provided all bundles are metal fiber bundles obtained through bundled drawing and wherein each bundle is still in the form of a composite wire, with each of the composite wires comprising a number of filaments in a matrix. This method further comprises the step of removing the matrix and sheet from the composite wires by dissolving the sheet and matrix in appropriate acid, after making the construction.

In a further method an exemplary metal fiber yarn according to the invention is obtained by providing at least 9 composite wires, each of said composite wires comprising a number of metal filaments in a matrix. Then a removable core is provided. Removal process can be any process of removing that does not change the spatial arrangement of the surrounding composite wires, such as: leaching, dissolving, burning, pulverising, evaporation, . . . . In one preferred embodiment this removable core is made of an iron wire. In an alternative preferred embodiment, this removable core is water-soluble e.g. made of polyvinylalcohol (PVA). In another preferred embodiment, the removable core comprises an acid susceptible polymer such as e.g. nylon or an acid susceptible metal such as e.g. copper.

A construction is then composed wherein the removable wire, fiber or yarn, or a group of removable wires, fibers and/or yarns, is in the core and the composite wires form at least two layers around this core. The composite wires are twisted around the removable core in two or more layers and in one or more steps. Thereafter, the matrix and sheet from the composite wires and the removable core are removed by dissolving, also called leaching, the sheet, matrix and removable core in appropriate liquid, e.g. acid. In an alternative embodiment, the matrix and sheet and removable core are removed in a two step process, wherein first the removable core is removed, e.g. by dissolving in a first liquid, e.g. water and in a second step the matrix and sheet are removed by dissolving in a second liquid, e.g. appropriate acid.

Preferably, the cabling angles of the different layers is set such that after leaching the cabling angles of the different layers become the same, which results in the fact that the length of all composite wires is substantially equal over a unit length of the construction. As the length of all composite wires is substantially equal over a unit length of the construction, the length of the metal fiber bundles is equal over a unit length of the metal fiber yarn after the leaching step. And, as the composite wires were twisted around the removable core, the length of the metal fiber bundles per unit length is larger than the length of the metal fiber yarn per unit length.

In an alternative method, the yarn can be obtained according to the methods described above, wherein at least part of the metal fiber bundles are plastically preformed, e.g. by crimping. More preferably, bundles in the same layer of the metal fiber yarn have the same amount of plastic deformation, e.g. crimp.

DEFINITIONS

The term "layer" in the metal fiber yarn is to be understood as a layer which is formed in the yarn by a group of bundles which stay in this layer along the length of the yarn. Bundles within a layer therefore have similar distance from their centre to the yarn's centre.

The term "equivalent diameter" of a fiber is to be understood as the diameter of an imaginary circle having a surface area equal to the surface of the radial cross section of the fiber. In case of the bundle drawing operation, the cross section of a fiber has usually a pentagonal or hexagonal shape, and the circumference of the fiber cross section is usually serrated as is shown in FIG. 2 of U.S. Pat. No. 2,050,298. In case of single drawn fibers, the equivalent diameter is to be understood as the diameter.

The term "fiber bundle" is to be understood as a grouping of individual continuous fibers.

The term "continuous fiber" is to be understood as a fiber of an indefinite or extreme length such as found naturally in silk or such as obtained by a wire drawing process. "Continuous metal fiber bundle" should in the context of this invention be understood as a bundle of continuous metal fibers, which can be obtained by bundling continuous metal fibers which were drawn till final diameter and bundled thereafter or obtained by bundled drawing wherein the bundle is obtained by leaching of the composite wire.

The term "yarn" is to be understood as a continuous strand of fibers, filaments or material in a form suitable for knitting, weaving, or otherwise intertwining to form a textile fabric. A yarn can therefore also be composed of first yarns taken together to form a new yarn.

The term "composite wire" is to be understood as the composite wire which is used in the bundled drawing process as known e.g. from U.S. Pat. No. 3,379,000, wherein the composite wire is the totality of metal filaments embedded in the matrix material enveloped in the sheath material. When the composite wire, which is drawn to final diameter, is leached, thereby removing the matrix and sheath material, the continuous metal filaments are released and are, from then on, called continuous metal fibers.

The term "unit length of a yarn" is to be understood as the unit length of the yarn when the yarn is in stretched condition.

The term "cabling angle" is known by the person skilled in the art, but in case of doubt, reference is made to the reference work K. Feyrer, Drahtseile: Bemessung, Betrieb, Sicherheit. Berlin: Springer-Verlag, 2000 on page 22-23.

The term "flexlife" is to be understood as "the resistance to rupture of the yarn under repetitive bending conditions" and is determined as the number of cycles that a bundle can be bended 180 degrees over a rod with a diameter of 20 mm under a load of 2N before it is broken. This test does not give absolute values, but gives a good comparison between different yarns.

BRIEF DESCRIPTION OF FIGURES IN THE DRAWINGS

Example embodiments of the invention are described hereinafter with reference to the accompanying drawings in which FIG. 1 shows a cross section through an example embodiment of the present invention.

FIG. 2 compares the load-elongation curves of two yarns according to the present invention, made in two different ways.

REFERENCE NUMBERS

Figure 1:
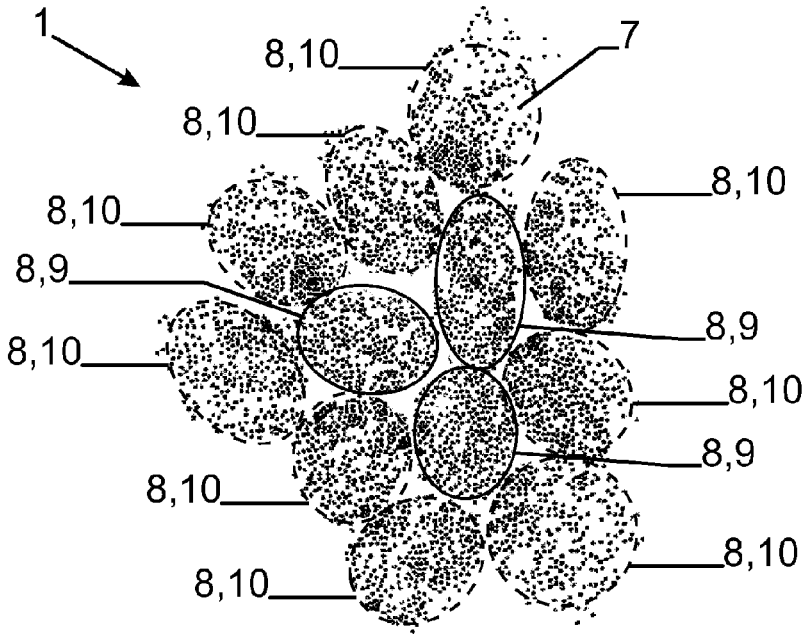

1: metal fiber yarn
2: horizontally movable clamp
3: rotatable clamp
4: wire
5: reversing pulley
6: weight (17 N)
7: metal fiber
8: metal fiber bundle
9: metal fiber bundle of $1^{st}$ layer
10: metal fiber bundle of $2^{nd}$ layer

MODE(S) FOR CARRYING OUT THE INVENTION

Examples of metal fiber yarns and different methods for obtaining the metal fiber yarn of the invention will now be described with reference to the Figures.

FIG. 1 is a cross section of a metal fiber yarn 1 composed of 3 metal fiber bundles 8,9 in the core and 9 metal fiber bundles 8,10 in the outer layer. Twelve composite wires comprising 275 AISI 316L filaments with an equivalent diameter of 12 micron were twisted around each other in one step and with 100 torsions per meter. Afterwards the composite matrix and sheet were dissolved in appropriate acid. In FIG. 1 the different bundle layers of the yarn are indicated: the bundles in the inner layer are indicated by ellipses with a full line border and with reference number 9; the bundles in the outer layer are indicated by ellipses with a dashed line border and with reference number 10.

The illustrated example of FIG. 1 comprises 12 metal fiber bundles 8, although in another example, another number of metal fiber bundles could be provided and/or the metal fiber bundles could be divided differently in the layers.

Figure 2:
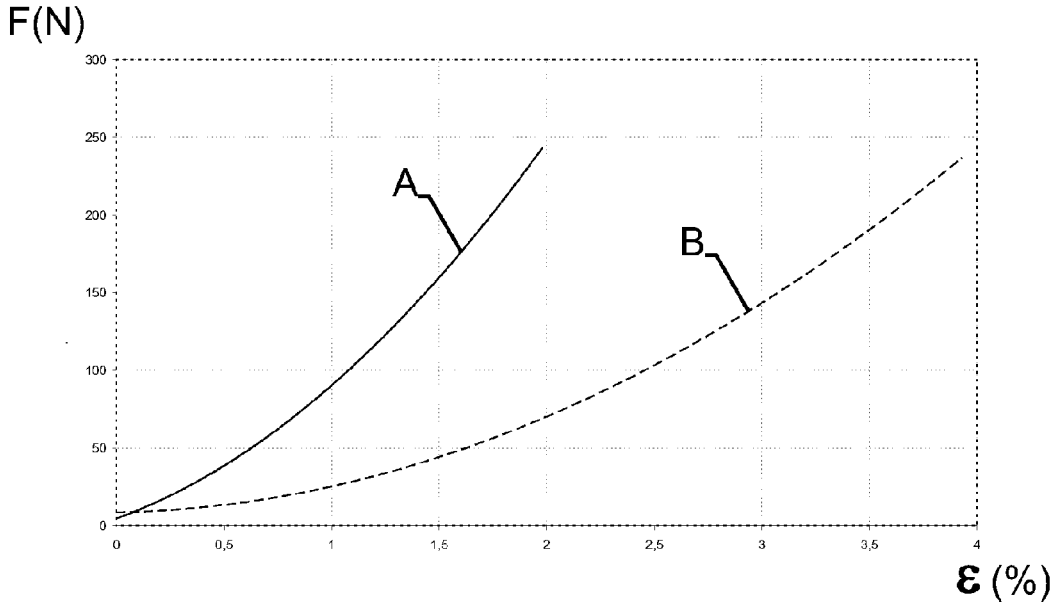

FIG. 2 shows the results of the load-elongation curves of two metal fiber yarns A and B according to the present invention. The abscissa is the elongation $\epsilon$, expressed in percent and the ordinate is the load F expressed in Newtons (N). As illustrated in FIG. 2, the mechanical behaviour of the yarn is different if the yarn is made in a different mode. Both yarns in the graph are composed of two layers, the inner layer comprising 3 fibre bundles and the outer layer comprising 9 fibre bundles. Each bundle comprises 275 continuous metal AISI 316L fibres with an equivalent diameter of 12 micron and all bundles are twisted around each other with 100 torsions per meter. The first yarn construction (A in FIG. 2) is made in one step: all composite wires are twisted around each other with 100 torsions per meter, this has as effect that the cabling angles of the different layers are different. The second yarn construction (B in FIG. 2) is made in two steps: first the core layer is made by twisting 3 composite wires around each other and with 100 torsions per meter; the second layer is made by twisting 9 composite wires around the core layer with 100 torsions per meter and in the same torsion direction, this was done as such that the cabling angles of the different layers are the same. For both constructions the composite matrix and sheet are dissolved in appropriate acid. As shown in FIG. 2, both yarns have the same strength, but yarn A made in one step shows less elongation compared to yarn B which is made in two steps. Both yarns show the same flex life behavior.

Figure 3:
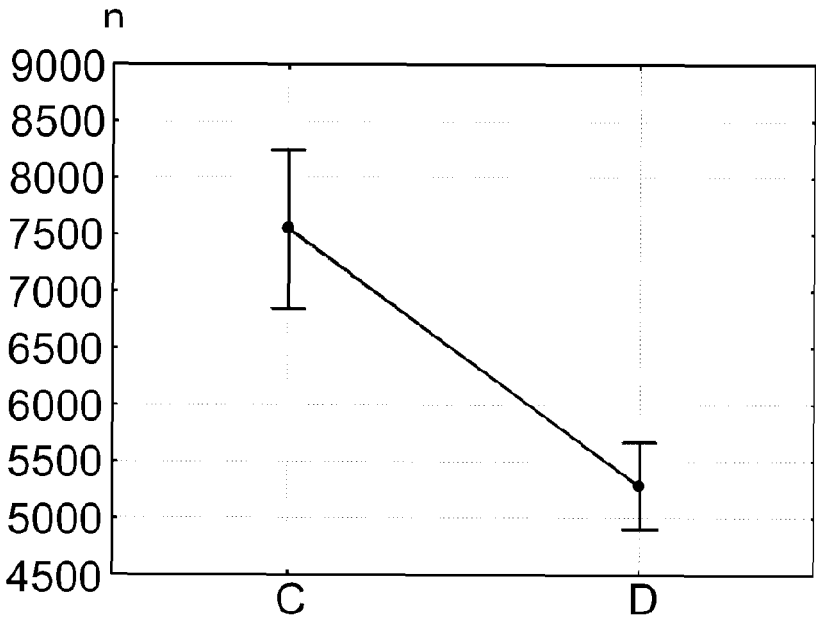
FIG. 3 is a graph showing the difference in flexlife between a simple metal fiber bundle and a metal fiber yarn of the invention with approx. the same amount of metal fibers.

FIG. 3 comprises the results of the flexlife tests on a comparison of a single bundle yarn (D in FIG. 3) and a multilayer yarn (C in FIG. 3) comprising a similar amount of filaments in the yarn and the same number of torsions per meter for all the bundles in the yarn. The first yarn (D in FIG. 3) is made in one step by twisting a composite wire comprising 1000 metal AISI 316L filaments with an equivalent diameter of 14 microns around its axes with 100 torsions per meter. The second yarn (C in FIG. 3) is a metal fiber yarn composed of 3 metal fiber bundles in the core and 9 metal fiber bundles in the outer layer. Each bundle comprises 90 metal AISI 316L filaments with an equivalent diameter of 14 microns. This yarn is made in two steps: first the core layer is made by twisting 3 composite wires around each other and with 100 torsions per meter; the second layer is made by twisting 9 composite wires around the core layer with 100 torsions per meter and in the same torsion direction, this was done as such that the cabling angles of the different layers are the same. For both constructions the composite matrix and sheet were dissolved in appropriate acid. The number of flex life cycles (n) for both yarns is given in FIG. 3. The results show that the multi-layer yarn (C in FIG. 3) can withstand many more cycles compared to the single bundle yarn (D in FIG. 3) while both yarns comprise a similar amount of filaments with the same equivalent diameter and the same number of torsions per meter are applied to the bundles in the yarns.

Figure 4:
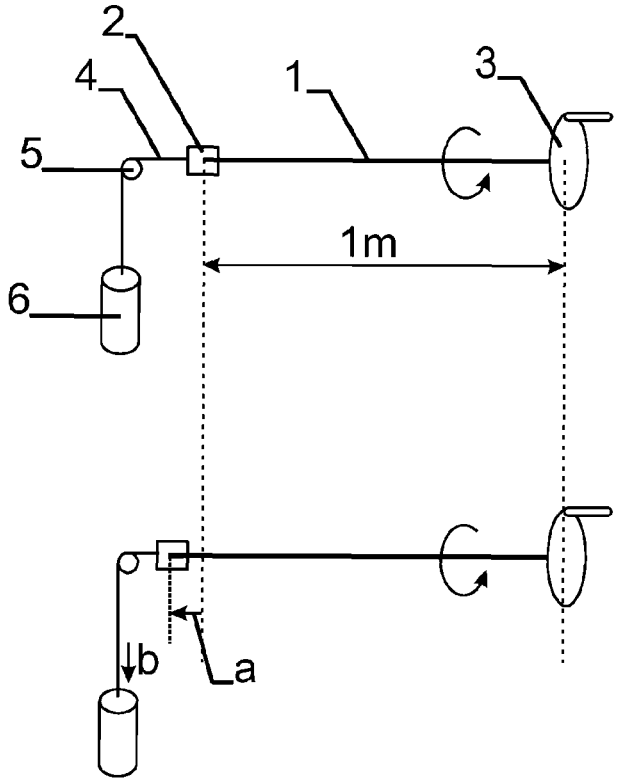
FIG. 4 shows the method for measuring length of fiber bundles in a yarn.

For the preferred embodiment (as e.g. yarn B of FIG. 2) wherein the length of the fiber bundles is substantially equal per unit length of said metal fiber yarn and at the same time these fiber bundles have a length per unit length of said metal fiber yarn which is larger than the unit length of the metal fiber yarn, the length of the individual fiber bundles in the metal fiber yarn is measured on a torsion bench as shown in FIG. 4. A length of 1 meter of metal fiber yarn (1) is clamped between two clamps as shown in FIG. 4. One of the clamps (3) is rotatable, but cannot move horizontally, the other clamp (2) is not rotatable but can move back and forward horizontally along the stretching direction of the yarn. The horizontally movable clamp (2) is put under load by means of a wire (4) guided over a reversing pulley (5) and connected to a load of 17 N (6). The yarn is then twisted in the inverse direction of the torsion direction of the metal fiber bundles in the yarn and as many cycles are made as the amount of torsion cycles present in the metal fiber yarn.

Because of the torsion being removed out of the yarn, the yarn elongates. As the yarn is put under tension by the weight (6), the load moves downwards (b). As a consequence the horizontally movable clamp (2) moves backwards and the elongation of the yarn is equal to the length (a) over which clamp (2) moves.

When the yarn consists out of multiple bundles with unequal lengths, the shortest bundle is under tension between the clamps and the other ones hang loose. The distance between the clamps is now the length of the shortest bundle in the yarn. When the shortest bundle is cut, the yarn elongates again and now the second shortest bundle in the original yarn is under tension. This time the distance between the clamps is the length of the second shortest bundle in the yarn. This cutting, elongation and measuring of the length is repeated until the last bundle is under tension.

The term "length of a yarn" is thus to be understood in the light of this invention, as the length of the yarn when the yarn is stretched under a load of 17 N. This is measured as the length L between the clamps on the torsion bench when the yarn is under the load of the 17 N and before the yarn is being reversely twisted.

The term "length of a bundle" is to be understood as the length $L_n$ of the single bundle $x_n$ originating from the reversely twisted yarn consisting out of n bundles and put under a load of 17 N. The length $L_1$ of the shortest bundle $x_1$ in the yarn is measured as the length between the clamps on the torsion bench when the yarn is reversely twisted and under a load of 17 N. The length $L_2$ of the second shortest bundle $x_2$ in the yarn is measured as the length between the clamps on the torsion bench when the yarn is reversely twisted, under a load of 17 N and the shortest bundle in the yarn $x_1$ has been cut through. The length $L_n$ of every $X_n^{th}$ bundle in a yarn is measured as the length between the clamps on the torsion bench when the yarn is reversely twisted, under a load of 17 N and all $x_1 \ldots x_{n-1}$ shorter bundles in the yarn have been cut.

The lengths of all bundles in a yarn are considered "substantially equal" if the difference in length between the bundles ΔL is lower than 1%, according to the formula $$\frac{\max(L_1 \ldots L_n) - \min(L_1 \ldots L_n)}{\min(L_1 \ldots L_n)} * 100\%$$

There is thus described a new metal fiber yarn with increased flexlife and strength. This new metal fiber yarn comprises at least 9 bundles of continuous metal fibers. Each of the bundles comprises at least 30 metal fibers. The at least 9 bundles are arranged in at least 2 layers of continuous metal fiber bundles as seen over a transverse cross section through the metal fiber yarn. Methods for obtaining this new metal fiber yarn are also disclosed.

What is claimed is:

1. A metal fiber yarn comprising at least 9 bundles of continuous metal fibers, wherein each of said continuous metal fiber bundles comprises at least 30 continuous metal fibers and said continuous metal fiber bundles are twisted together with a predetermined number of torsions per meter to form a metal fiber yarn, wherein said at least 9 bundles of continuous metal fibers are arranged in at least 2 layers over a transverse cross section of said metal fiber yarn, wherein a layer cabling angle and/or direction are not equal over all layers.

2. A metal fiber yarn according to claim 1, wherein said at least 9 bundles of continuous metal fibers are arranged in at least 3 layers over a transverse cross section of said metal fiber yarn.

3. A metal fiber yarn according to claim 1, wherein the at least 2 layers are twisted in the same direction.

4. A metal fiber yarn according to claim 1, wherein at least part of said metal fibers are bundle drawn metal fibers.

5. A metal fiber yarn according to claim 1, wherein at least part of said metal fibers are made of stainless steel.

6. A metal fiber yarn according to claim 1, wherein the length of said fiber bundles is substantially equal per unit length of said metal fiber yarn and wherein the length of fiber bundles per unit length of said metal fiber yarn is larger than the unit length of said metal fiber yarn.

7. A metal fiber yarn comprising at least 9 bundles of continuous metal fibers, wherein each of said continuous metal fiber bundles comprises at least 30 continuous metal fibers and said continuous metal fiber bundles are twisted together with a predetermined number of torsions per meter to form a metal fiber yarn, wherein said at least 9 bundles of continuous metal fibers are arranged in at least 2 layers over a transverse cross section of said metal fiber yarn, wherein at least part of the metal fibers in said metal fiber bundles have a cross section comprising at least one concentric metal layer over a metal core.

8. A metal fiber yarn according to claim 7, wherein the core of said fibers is copper and an outer layer is stainless steel.

9. A metal fiber yarn according to claim 7, wherein the core of said fibers is stainless steel and an outer layer is copper.

10. A metal fiber yarn according to claim 1, wherein said yarn comprises continuous metal fiber bundles having the same amount of fibers per bundle.

11. A method for producing a metal fiber yarn comprising:

providing at least 9 continuous metal fiber bundles, each of said continuous metal fiber bundles comprising at least 30 continuous metal fibers, twisting together part of said at least 9 metal fiber bundles with a predetermined number of torsions per meter, thereby obtaining a first layer, and twisting the remainder of said at least 9 metal fiber bundles around said first layer with the predetermined number of torsions per meter in at least one next layer, wherein a layer cabling angle and/or direction are not equal over all layers.

12. A method for producing a metal fiber yarn comprising:

providing at least 9 continuous metal fiber bundles, each of said continuous metal fiber bundles comprising at least 30 continuous metal fibers, and twisting together all of said metal fiber bundles with a predetermined number of torsions per meter thereby obtaining a metal fiber yarn, wherein said at least 9 bundles of continuous metal fibers are arranged in at least 2 layers over a transverse cross section of said metal fiber yarn, wherein a layer cabling angle and/or direction are not equal over all layers.

13. A method for producing a metal fiber yarn comprising:

providing at least 9 composite wires drawn to final diameter, each of said at least 9 composite wires comprising at least 30 continuous metal fibers, twisting together part of said at least 9 composite wires with a predetermined number of torsions per meter thereby obtaining a first layer, twisting the remainder of said at least 9 composite wires around said first layer with the predetermined number of torsions per meter, in at least one next layer, thereby obtaining a composite wire construction, and leaching said composite wire construction in appropriate acid, thereby obtaining the metal fiber yarn.

14. A method for producing a metal fiber yarn comprising:

providing at least 9 composite wires drawn to final diameter, each of said composite wires comprising at least 30 continuous metal fibers, twisting together all of said composite wires with a predetermined number of torsions per meter, thereby obtaining a composite wire construction, and leaching said composite wire construction in appropriate acid, thereby obtaining the metal fiber yarn.

* * * * *